United States Patent [19]

Habiby et al.

[11] 4,021,333

[45] May 3, 1977

[54] METHOD OF REREFINING OIL BY DISTILLATION AND EXTRACTION

[75] Inventors: Emile Najib Habiby, Willowick; Richard William Jahnke, Mentor-on-the-Lake, both of Ohio

[73] Assignee: The Lubrizol Corporation, Cleveland, Ohio

[22] Filed: Aug. 27, 1975

[21] Appl. No.: 608,317

[52] U.S. Cl. ..... 208/179; 208/181; 208/184

[51] Int. Cl.[2] ..... C10M 11/00

[58] Field of Search ..... 208/179, 184, 181

[56] References Cited

UNITED STATES PATENTS

| | | | |
|---|---|---|---|
| 3,173,859 | 3/1965 | Chambers | 208/184 |
| 3,625,881 | 12/1971 | Chambers et al. | 208/179 |
| 3,919,076 | 11/1975 | Cutler et al. | 208/184 |

*Primary Examiner*—Delbert E. Gantz
*Assistant Examiner*—James W. Hellwege
*Attorney, Agent, or Firm*—James W. Adams, Jr.; William H. Pittman

[57] ABSTRACT

Used oil is rerefined by distilling it to remove a volatile forecut followed by a fraction of lubricating viscosity; the latter is then extracted with an immiscible liquid extractant to remove impurities. As optional preliminary steps, the oil may be diluted with a volatile diluent and insoluble impurities removed therefrom, and heated with an aqueous solution of a strongly alkaline material to concentrate metallic constituents (such as metal-containing additives) in a solid sludge.

15 Claims, No Drawings

METHOD OF REREFINING OIL BY DISTILLATION AND EXTRACTION

This invention relates to a method of rerefining oil for use in lubricants and the like. More particularly, it relates to a method of recovering oil of lubricating viscosity from used oil which comprises the steps of:

A. Distilling said used oil to remove therefrom a forecut having a viscosity substantially less than that of lubricating oil and a flash point (Tag or Pensky-Martens method) less than 121° C.;

B. Continuing the distillation to recover a distillate having substantially the viscosity of lubricating oil;

C. Extracting impurities from the distillate of step B with an organic liquid extractant which is substantially immiscible with said distillate; and D. Removing said organic liquid and impurities dissolved therein from said distillate.

It is well known that large quantities of petroleum-derived oil are used for the lubrication of machinery of many kinds, including internal combustion engines. Because of the current interest in conservation of petroleum, it is desirable to develop methods for rerefining or reconditioning used oil. Such reconditioning is usually required before reuse since the used oil almost always contains degradation products derived from the oil itself or from additives therein, as well as particles of metal, metal oxides and the like from the engine or other machinery.

A principal object of the present invention, therefore, is to provide a method for rerefining used oil to produce poil capable of further use as a lubricant, fuel or petro-chemical intermediate or for similar purposes.

A further object is to provide a rerefining method which is relatively inexpensive and which affords as a product oil roughly comparable in properties to newly refined lubricating oil.

Other objects will in part be obvious and will in part appear hereinafter.

The method of this invention is applicable to any used oil of lubricating viscosity. This includes used crankcase oil from motor vehicles (e.g., cars, trucks, locomotives), automatic transmission fluids and other functional fluids in which the major constituent is an oil of lubricating viscosity, and waste oil from industrial lubrication applications. It may be used with synthetic oils, including synthetic hydrocarbons, halo-substituted hydrocarbons, alkylene oxide polymers and interpolymers and derivatives thereof, ester- or silicon-based oils, and the like. However, its principal utility is with petroleum-based hydrocarbon oils. In the remainder of this specification, the oils referred to will be petroleum-based oils (i.e., mineral oils), but it is to be understood that synthetic oils of the above and similar types may be substituted therefor.

In step A of the method of this invention, the used oil is distilled to remove therefrom a relatively volatile forecut comprising such materials as water, gasoline and/or fuel oil which may have become mixed with the lubricating oil during use, and other volatiles. A single forecut containing all volatiles may be removed, or it may be divided into a relatively more volatile and a less volatile forecut, the former generally comprising water and extremely light ends such as gasoline, and the latter comprising heavier and somewhat less volatile materials including kerosene, fuel oil and the like.

The forecut may be identified by its flash point, which when measured by the Tag Closed Cup method (ASTM D56) or the Pensky-Martens Closed Cup method (ASTM D93) is less than 121° C. (250° F.). Since the Pensky-Martens method is the one generally used for fuel oils and similar materials having a flash point as high as 250° F., this is the method by which the flash point will ordinarily be determined. However, the flash point of the forecut may be determined by either method in accordance with this invention.

For the purposes of this invention, it is usually preferred to conduct the distillation without a fractionation column or similar apparatus. However, it may be advantageous to employ demister means such as a short length of tubing containing coiled wire or the like, to minimize carry-over of tarry material into the distillate.

The distillation may be effected at atmospheric or reduced pressure. Because of limitations on the equipment used with respect to heat stability, it is usually preferred to employ reduced pressures, typically in the range of 1.5–10.0 torr. When pressures in this range are used, the forecut can generally be recovered at a maximum vapor temperature no higher than about 250° C.

In step B, the distillation is continued as the relatively non-volatile lubricating oil fraction is recovered. This fraction will, of course, have a substantially higher flash point than the forecut of step A, and will also distill at substantially higher temperatures. Generally, it is found that the major portion, and usually all, of the distillate of step B can be recovered at a vapor temperature no higher than about 300° C. and usually below about 290° C. when the distillation is carried out at a pressure of 1.5–10.0 torr. The residue from step B is liquid, relatively non-toxic and non-polluting, and may be easily disposed of. Alternatively, it may be used as an extender for asphalt or rubber, or in similar applications.

In step C, remaining impurities are extracted from the distillate of step B with an organic liquid extractant which is substantially immiscible therewith. The word "immiscible" as used herein denotes a situation in which two liquids are completely insoluble in each other; that is, in which they form two phases regardless of the proportions in which they are mixed.

Extraction is continued for long enough to remove from the oil substantially all impurities which are soluble in the extractant. The amount of extractant if not critical, particularly in view of the fact that used extractant can be purified (e.g., by distillation) and recirculated. It is frequently convenient to use about 20–50 parts by weight of extractant per 100 parts of the distillate of step B, but more extractant can, of course, be used if desired. The extraction is usually carried out at about 20°–50° C., typically at ambient temperature, and at atmospheric pressure.

The extractant is generally one which is substantially inert, under the conditions of the extraction, to the distillate of step B. A wide variety of liquids, mostly polar liquids, may be used as extractants. They include the following (as well as mixtures thereof):

Ethanol
Diacetone alcohol
Ethylene glycol mono-(lower alkly) ethers
Diethylene glycol
Diethylene glycol mono-(lower alkyl) ethers
o-Chlorophenol
Furfural
Acetone Formic acid
4-Butyrolactone
Lower alkyl esters of lower mono- and dicarboxylic acids
Dimethylformamide
2-Pyrrolidone and N-(lower alkyl)-2-pyrrolidones
Epichlorohydrin
Dioxane
Morpholine, lower alkyl and amino-(lower alkyl-) morpholines
Benzonitrile
Di-(lower alkyl) sulfoxides
Di-(lower alkyl) (lower alkyl)phosphonates.

Especially preferred are compounds from the above list which have a boiling point in the range 120°–225° C. at one atmosphere pressure and a specific gravity in the range 0.90–1.05, measured at 20° C. in comparison with water at 4° C. Within this subgroup, a particular preference is expressed for ethylene glycol monomethyl ether, dimethylformamide and N-methyl-2-pyrrolidone.

In step D, the extractant and impurities are removed from the distillate oil. The greater part of the extractant and impurities can be removed merely by allowing the liquid mixture to separate into two phases, one of which is principally oil. Sometimes, however, a small amount of extractant is entrained or dissolved in the oil, and in this event it may be removed by evaporation under vacuum or by other suitable means. The removed extractant liquid can be purified (e.g., by distillation) and recirculated for further extraction.

This invention includes methods in which certain steps are employed in addition to those described hereinabove. For example, it is frequently advantageous to employ a preliminary step of adding a diluent to said oil and removing (e.g., by filtration or centrifugation) insoluble impurities from the solution of said oil in said diluent. Suitable diluents for this step are organic liquids in which the oil is soluble and which are substantially inert thereto and volatile enough for easy removal by distillation, vacuum stripping or the like after insolubles have beem removed. For the latter purpose, the diluent will usually have a boiling point at atmospheric pressure no higher than about 150° C. Examples of suitable diluents are hydrocarbons such as naphtha and hexane; lower alkanols such as methanol, 2-propanol and 2-butanol; and lower alkanones such as acetone and methyl ethyl ketone. Mixtures of these diluents may also be used. The ratio of diluent of oil may be chosen so as to provide optimum separation from insoluble impurities; a weight ratio between about 3:1 and 10:1 is typical. The dilution and separation steps are normally carried out at about 10°–50° C., typically at ambient temperature.

A further optional step in the method of this invention involves heating the used oil with an aqueous solution of a strongly alkaline material prior to the addition of the diluent discussed hereinabove. Typical alkaline materials are alkali metal hydroxides such as sodium hydroxide and potassium hydroxide and quaternary ammonium hydroxides, with sodium hydroxide being preferred because of its commercial availability. The amount of alkali is not critical but is typically about 0.5–5.0% (by weight) based on the weight of the used oil, and the alkaline solution is typically about 5–20% alkali by weight. The alkaline treatment step typically involves temperatures of about 100°–150° C., especially about 100°–125° C.

The advantage of alkaline treatment is that metallic constituents of the used oil are concentrated in a solid sludge which is readily removed in the subsequent dilution step, resulting in a relatively clean material to be subjected to distillation.

Oil which has been rerefined by the method of this invention may be reconverted into lubricants, used as bunker fuel or the like, or used as an intermediate for petrochemicals. The term "of lubricating viscosity" when used herein does not limit the utility of the oil to lubricating, but is merely a description of a property thereof.

The method of this invention is illustrated by the following examples. All parts are by weight unless otherwise indicated.

EXAMPLE 1

One thousand parts of used crankcase oil is distilled and a volatile forecut is obtained boiling up to 171° C./10 torr. Distillation is continued at 2 torr, and an additional forecut fraction is recovered boiling up to 221° C. Distillation is continued as 687 parts of lubricating oil fraction is collected, boiling up to 304° C./2 torr.

The lubricating oil fraction is extracted with 275 parts of dimethylformamide in a multi-stage continuous countercurrent extractor. The dimethylformamide extracts are distilled at 99°–105° C./2–5 torr, yielding purified dimethylformamide for further use. The extracted oil is stripped at temperatures up to 110° C./10 torr, yielding 657 parts of rerefined oil.

EXAMPLE 2

Five hundred parts of used crankcase oil is diluted with 576 parts of a 9:1 mixture of 1-butanol and methanol. Insolubles are removed by means of a DeLaval clarifier and the solvent is removed by distillation, yielding 416 parts of clarified oil.

The clarified oil is distilled and a volatile forecut is obtained boiling up to 125° C./2 torr. The lubricating oil fraction is then collected boiling up to 265° C./2 torr. This fraction is extracted with N-methyl-2-pyrrolidone according to the procedure of Example 1. The yield of rerefined oil is 400 parts.

EXAMPLE 3

Nine hundred grams of used crankcase oil is heated for 4 hours at 114°–117° C. with a solution of 9 grams of sodium hydroxide in 45 grams of water. The water is removed from the mixture by blowing with nitrogen, and the residue is heated to 150° C. and cooled to room temperature. To the oil is added 3100 ml. of a 2-propanol-hexane mixture comprising 2.8 parts by volume of 2-propanol and 2.2 parts of hexane, and containing 2% water. The solution is centrifuged, washed with water and stripped under vacuum to yield 856 grams of clarified oil.

The clarified oil (800 grams) is distilled; after the collection of a volatile forecut boiling up to 187° C./0.25 torr, the lubricating oil fraction is collected at temperatures up to 293° C./0.35 torr. The distillate is extracted with N-methyl-2-pyrrolidone according to the procedure of Example 1 to yield the desired purified oil.

What is claimed is:

1. A method of recovering oil of lubricating viscosity from used oil which comprises the steps of:

A. Distilling said used oil to remove therefrom a forecut having a viscosity substantially less than that of lubricating oil and a flash point (Tag or Pensky-Martens method) less than 121° C.;

B. Continuing the distillation to recover a distillate having substantially the viscosity of lubricating oil;

C. Extracting impurities from the distillate of step B with an organic liquid extractant which is substantially immiscible with said distillate; and D. Removing said organic liquid and impurities dissolved therein from said distillate.

2. A method according to claim 1 wherein the extractant of step C is at least one of the following:

Ethanol
Diacetone alcohol
Ethylene glycol mono-(lower alkyl) ethers
Diethylene glycol
Diethylene glycol mono-(lower alkyl) ethers
o-Chlorophenol
Furfural
Acetone
Formic acid
4-Butyrolactone
Lower alkyl esters of lower mono- and dicarboxylic acids
Dimethylformamide
2-Pyrrolidone and N-(lower alkyl)-2-pyrrolidones
Epichlorohydrin
Dioxane
Morpholine, lower alkyl and amino-(lower alkyl)-morpholines
Benzonitrile
Di-(lower alkyl) sulfoxides
Di-(lower alkyl) (lower alkyl) phosphonates.

3. A method according to claim 2 wherein the distillation of step B is carried out under reduced pressure.

4. A method according to claim 3 wherein the extractant of step C has a boiling point at one atmosphere pressure in the range 120°–225° C. and a specific gravity, measured at 20° C. in comparison with water at 4° C., in the range 0.90–1.05.

5. A method according to claim 4 wherein the extractant of step C is ethylene glycol monomethyl ether, dimethylforamide or N-methyl-2-pyrrolidone.

6. A method according to claim 2 which includes a preliminary step of adding a diluent, in which said used oil is substantially soluble and which is substantially inert thereto, to said oil, and removing insoluble impurities from the solution of said oil in said diluent.

7. A method according to claim 6 wherein the diluent has a boiling point at atmospheric pressure no higher than about 150° C. and is selected from the group consisting of aliphatic hydrocarbons, lower alkanols, lower alkanones, and mixtures thereof.

8. A method according to claim 7 wherein the distillation of step B is carried out under reduced pressure.

9. A method according to claim 8 wherein the extractant of step C has a boiling point at one atmosphere pressure in the range 120°–225° C. and a specific gravity, measured at 20° C. in comparison with water at 4° C., in the range 0.90–1.05.

10. A method according to claim 9 wherein the extractant of step C is ethylene glycol monomethyl ether, dimethylformamide or N-methyl-2-pyrrolidone.

11. A method according to claim 6 wherein, prior to the addition of said diluent, said used oil is heated with an aqueous solution of a strongly alkaline material, said aqeuous solution being about 5–20% alkali by weight.

12. A method according to claim 11 wherein the strongly alkaline material is sodium hydroxide.

13. A method according to claim 12 wherein the distillation of step B is carried out under reduced pressure.

14. A method according to claim 13 wherein the extractant of step C has a boiling point at one atmosphere pressure in the range 120°–225° C. and a specific gravity, measured at 20° C. in comparison with water at 4° C., in the range 0.90–1.05.

15. A method according to claim 14 wherein the extractant of step C is ethylene glycol monomethyl ether, dimethylforamide or N-methyl-2-pyrrolidone.

* * * * *